US007749925B2

(12) United States Patent
Morton

(10) Patent No.: US 7,749,925 B2
(45) Date of Patent: Jul. 6, 2010

(54) METHOD FOR PERMEABILITY CONTROL OF PMC

(75) Inventor: Antony Morton, Ilkley (GB)

(73) Assignee: Voith Patent GmbH, Heidenheim (DE)

( * ) Notice: Subject to any disclaimer, the term of this patent is extended or adjusted under 35 U.S.C. 154(b) by 242 days.

(21) Appl. No.: 11/227,773

(22) Filed: Sep. 14, 2005

(65) Prior Publication Data

US 2006/0062960 A1 Mar. 23, 2006

(30) Foreign Application Priority Data

Sep. 15, 2004 (DE) ..... 10 2004 044 569

(51) Int. Cl.
*B32B 5/12* (2006.01)
*B32B 27/04* (2006.01)
*B32B 27/12* (2006.01)
*D21F 7/08* (2006.01)

(52) U.S. Cl. ..... 442/269; 442/2; 442/169; 442/180; 442/195; 442/277; 442/281; 428/114; 162/900; 162/902; 162/903; 139/383 R; 139/383 A; 139/420 C

(58) Field of Classification Search ..... 442/32, 442/35; 162/358.1, 325.2
See application file for complete search history.

(56) References Cited

U.S. PATENT DOCUMENTS

| | | | | | |
|---|---|---|---|---|---|
| 3,279,504 | A | * | 10/1966 | Wagner | 139/419 |
| 3,323,226 | A | | 6/1967 | Beaumont et al. | 34/95 |
| 4,142,557 | A | * | 3/1979 | Kositzke | 139/425 A |
| 4,172,910 | A | * | 10/1979 | Rotar | 427/243 |
| 4,529,480 | A | | 7/1985 | Trokhan et al. | |
| 4,541,895 | A | | 9/1985 | Albert | 162/348 |
| 5,187,005 | A | * | 2/1993 | Stahle et al. | 442/208 |
| 5,346,932 | A | | 9/1994 | Takahashi | |
| 5,637,375 | A | | 6/1997 | Hohman | |
| 5,971,879 | A | * | 10/1999 | Westhoff | 474/260 |
| 6,042,592 | A | * | 3/2000 | Schmitt | 606/151 |
| 6,337,112 | B1 | | 1/2002 | Watanabe | |
| 6,531,418 | B1 | | 3/2003 | Lidar et al. | |
| 2003/0160050 | A1 | * | 8/2003 | Carter et al. | 220/9.1 |
| 2004/0104005 | A1 | * | 6/2004 | Brewster et al. | 162/358.2 |

FOREIGN PATENT DOCUMENTS

| | | | |
|---|---|---|---|
| EP | 0 285 376 A | | 10/1988 |
| GB | 2102731 A | * | 2/1983 |
| GB | 2 235 705 | | 3/1991 |
| WO | WO 93/01350 A | | 1/1993 |

OTHER PUBLICATIONS

"Non-woven" Complete Textile Glossary, Celanese Acetate, 2001.*
European Search report Dec. 28, 2005.
Internet article entitled, "Woven Fabrics in Polymeric Composite Materials", at http://www.azom.com/Details,asp?ArticleID=1091, article claims a "Date Added" date of Dec. 3, 2001.

* cited by examiner

*Primary Examiner*—Jennifer A Chriss
(74) *Attorney, Agent, or Firm*—Taylor & Aust, P.C.

(57) ABSTRACT

An industrial fabric having a composite layer, the composite layer having a non-woven mesh layer structure and a yarn layer structure being parallel to the non-woven mesh layer structure. The yarn layer structure has first and second yarns, with the first yarns being connected to the second yarns to form a mesh like structure, and the yarn layer structure being embedded into the non-woven mesh layer structure.

12 Claims, 3 Drawing Sheets

METHOD FOR PERMEABILITY CONTROL OF PMC

CROSS-REFERENCE TO RELATED APPLICATIONS

The present application claims priority under 35 U.S.C. §119 of German Patent Application No. 10 2004 044 572.9 filed on Sep. 15, 2004, the disclosure of which is expressly incorporated by reference herein in its entirety.

BACKGROUND OF INVENTION

1. Field of the Invention

The present invention relates to industrial fabrics, particular paper machine clothing e.g. as forming fabrics, dryer fabrics or base cloths of press felts.

2. Discussion of Background Information

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Papermachine clothing is essentially employed to carry the paper web through these various stages of the papermaking machine. In the forming section the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. In the final stage, the paper web is transferred either to a Yankee dryer, in the case of tissue paper manufacture, or to a set of dryer cylinders upon which, aided by the clamping action of the dryer fabric, the majority of the remaining water is evaporated.

Industrial fabrics like Paper machine clothing are mainly manufactured by weaving. The yarns used for weaving can be for example of single or twisted monofilament, multifilament or spun bound type. Materials used are based on polyester, polyamide or polyphenylene sulphide (PPS).

The weaving process is characterized in that the finished fabric comprises interwoven warp and weft yarns, whereby the warp and weft yarns cross over each other at cross-over points resulting in the fact that a woven fabric never can have totally flat surfaces. Therefore fabrics often are characterized by surface features that are predominantly made up of warp or weft dominated arrays.

For some applications it is desirable to have fabrics with flat surfaces. E.g. in the dryer section one function of the dryer fabric is to give sufficient heat transfer from the heated surface e.g. of a drying cylinder to the sheet of paper. This is typically achieved by sandwiching the paper sheet between the dryer fabric and the drying cylinder. The effectiveness of the heat transfer is determined by factors such as pressure applied to press the sheet against the heated cylinder and the contact density (contact area and contact points), that means the contacting surface between the dryer fabric and the sheet.

A drawback of woven fabrics is that they are showing the property of "crimp" caused by the over and under arrangement of the warp and weft yarns. After the weaving process mainly the warp yarns are crimped. During the heat stabilizing process, where heat and tension simultaneously is applied to the fabric, some of the crimp is lost from the warp yarns but imparted into the weft yarns, this is called "crimp interchange".

Fabrics have to exhibit uniform properties for example characterized by their vapour and/or water permeability, caliper, surface topographie, tension, dimensional stability etc. through their entire length and width. These properties have to maintain stable over their entire life time. Sometimes the performance of woven fabrics in maintaining properties over their life is not satisfactory.

As a result from the weaving process, the woven fabric has a woven structure with channels for water and vapour passage resulting in a certain water and vapour permeability of the fabric. In the forming and pressing section of a paper making machine mainly the water permeability of the fabric is important to control the liquid dewatering and to avoid rewetting of the sheet. In the dryer section mainly the vapour permeability of the fabric is important to control the passage of moisture vapour from the sheet through the fabric.

Further woven fabrics are not easy to clean because of their complex 3-dimensional open structure. This issue becomes more and more important due to the fact that within the paper making process there is a constant drive towards more and more recycled material to be used including more contaminants. This leads to increased contaminations of the fabric.

To overcome some of the above mentioned drawbacks non woven fabrics have been proposed.

U.S. Pat. No. 3,323,226 describes a synthetic dryer fabric made by mechanical perforating polymeric sheet material.

U.S. Pat. No. 4,541,895 describes a paper makers fabric made up of a plurality of impervious non-woven sheets joined together in a laminated arrangement to define the fabric or belt. Defined throughout the fabric are drainage apertures which are created by drilling techniques.

GB 2 235 705 describes a method for manufacturing a non-woven fabric where an array of sheath core yarns of which the core has a higher melting point than the sheath, is fed in spaced parallel disposition to peripheral grooves of a pinned roller arranged in nip forming relationship with a press roll. Thereby the material of the sheath is melted as the yarns move into and through the roller nip and excess melted sheath material is forced into lateral grooves in the roller to form structural members between adjacent yarns.

All the above mentioned non-woven structures are showing unsatisfactory dimensional and thermal stability.

SUMMARY OF THE INVENTION

It is the object of the present invention to provide an industrial fabric which has an improved thermal and dimensional stability.

It is further an object of the present invention to provide an industrial fabric which can be manufactured more economic than existing non-woven fabrics.

It is in addition an object of the present invention to provide an industrial fabric whose the permeability can be easy adjusted during manufacturing.

It is another object of the present invention to provide a method of manufacturing an above mentioned industrial fabric.

According to a first aspect of the present invention there is provided an industrial fabric having a composite layer, said composite layer comprising a non-woven mesh layer structure and a yarn layer structure being parallel arranged thereto. The fabric according to the invention is characterized in that said yarn layer structure has first and second yarns, said first yarns being connected to said second yarns to form a mesh like structure and the yarn layer structure being at least in part embedded into said non-woven mesh layer structure. The non-woven mesh layer structure is formed by a polymeric matrix material. The polymeric matrix material is formed as a layer and forms a matrix phase of the composite layer and thereby has a continuous character. The polymeric matrix material is thus not itself a fiber batt.

By embedding a mesh like yarn layer structure at least in part into a non-woven mesh layer structure a composite layer is created being reinforced in two dimension. Therefore according to the invention the dimensional and thermal stability of the composite layer is improved in both of the two directions of the layer, compared to composite layer fabrics only having parallel yarns extending into one or two directions but not being connected to each other.

Further the manufacturing of such a fabric is much more economic and therefore cost effective compared to composite fabric only having non connected yarns extending in one or both directions of the two dimensions of the layer, because for manufacturing only the yarn layer structure has to laid down onto the non-woven mesh layer structure.

Further the composite layer can be manufactured adapted to the particular application of the industrial fabric and produced to achieve the required permeability by choosing suitable non-woven mesh layer structure to be combined with suitable yarn layer structure. Depending e.g. on the mesh size, material and structure of the non-woven mesh layer structure combined with the yarn layer structure e.g. having its specific mesh size, material and structure and e.g. depending on the relative arrangement of the layer structures a composite layer for an industrial fabric can be produced for a broad field of application without changing the physical production set-up.

According to a first embodiment of the present invention said first yarns of the yarn layer structure are interwoven with said second yarns of the yarn layer structure to form the two dimensional layer structure in a well know and cost effective manner. But there are also a variety of other possibilities to connect first yarns with second yarns e.g. to knot the yarns at the crossing points and or to connect first yarns with second yarns by gluing or melting etc.

Preferably the weave is based on a single layer structure and/or plain weave or a Leno weave. The Leno weave is of particular interest as it gives rise to an open mesh structure with good dimensional stability.

At least some of said first and/or second yarns can be monofilament and/or twisted monofilament and/or multifilament and/or spun type yarns.

Further at least some of said first and/or second yarns comprise material with a lower thermal expansion coefficient than thermoplastic materials. Glass fibre, KEVLAR (poly para-phenylene terephthalamide) and NOMEX (poly meta-phenylene isophthalamide) are such materials. Glass fibre has a coefficient of linear thermal expansion that is typically around 2 orders of magnitude (10exp2) smaller than typical unfilled thermoplastic elastomers. This means that the amount of dimensional change over the temperature range encountered on a paper machine dryer section can be reduced dramatically by using a composite structure whereby glass fibre combined with thermoplastic elastomer. Glass fibre material is completely inert to the environmental conditions encountered on a paper making machine. The material does not necessarily have to be glass fibre. Other materials, such as the aromatic aramid based fibres—Kevlar and Nomex could equally be used. The objection to using these materials is purely due to the fact that they are cost prohibitive when compared to glass fibre.

Ideally at least some of said first and/or second yarns are flat yarns such that at the warp-weft yarns cross over points no "knuckles" result to the structure.

To improve the dimensional and thermal stability for the industrial fabric comprising the composite layer it is advantageous if said first yarns extend into the intended machine direction of said fabric and/or said second yarns extend into the intended cross machine direction of said fabric.

The permeability of the fabric according to the invention can be easy adjusted if the mesh structure of said non-woven mesh layer structure is different to the mesh structure of said yarn layer structure. In this case e.g. the mesh size of the non-woven mesh layer can be smaller or larger than the mesh size of the yarn layer structure.

Further the inventors came to the perception that the permeability of the composite layer can be influenced by the relative arrangement of the non-woven mesh layer structure to the yarn layer structure and therefore can be adjusted easily.

One concrete example how the permeability of the industrial fabric can be influenced is, that the non-woven mesh layer structure and the yarn layer structure are arranged in such a manner that at least some of the first and/or the second yarns extend in the aperture of the non-woven mesh layer structure.

In addition to strengthen the stability e.g. in the load bearing MD direction of the industrial fabric according to a further embodiment the non-woven mesh layer can comprise parallel arranged reinforcing yarns cross linked by the polymer matrix material and being embedded in said polymer matrix material.

Therefore according to preferred embodiment the reinforcing yarns extend in the intended machine direction of said fabric.

According to a further embodiment the melting temperature of said reinforcing yarns and/or of said first and second yarns is higher than the melting temperature of said matrix material. In a concrete example the non-woven mesh layer structure is manufactured from a core/sheath yarn in a pin drum process wherein the core material has a higher melting point as the sheath material. The sheath material after melting flows to connect adjacent yarns and thereby forms together with the core of the yarns the mesh structure. In the molten sheath material, now cross linking the yarns, the yarn layer structure is embedded.

The industrial fabric according to the invention is suitable for a variety of applications. Preferably the industrial fabric is a paper machine clothing, e.g. a forming fabric or a dryer fabric or a press felt or a transfer belt.

According to a second aspect of the invention there is provided a method of manufacturing an industrial fabric. The method comprises the steps of applying a yarn layer structure having first and second yarns being connected to each other to form a mesh like structure to molten polymer material after formation or during formation of a non-woven mesh layer structure in such a manner that said yarn layer structure is embedded into said non-woven mesh layer structure.

The non-woven mesh layer structure preferably is manufactured by the above mentioned pin drum process. Therefore:

According to a embodiment of the method according to the invention the method further comprises the steps of providing an array of spaced apart yarns, each of said yarns having a polymeric sheath thereto, heating the array to melt the said polymeric material, constraining subsequent flow movement of said material to predetermined paths extending between and cross linking adjacent yarns to form a matrix in mesh form.

Further according to a further embodiment of the method of the invention the flow movement of the polymeric material is constrained to individual paths arranged in spaced apart disposition in the longitudinal direction of said yarns.

In addition the paths can be provided by a pinned drum.

Further the flow movement of the polymeric material can be influenced by pressure applied to the polymeric material perpendicular to the flow moving directions. By doing this, the polymeric material will be forced to flow in all the predetermined path to fully generate the non-woven mesh layer structure.

According to a preferred embodiment the pressure is provided by a press-nip formed between the pinned drum and a press roll or can be provided by a nip formed between the pinned drum and a doctor blade.

To ensure that the yarn layer structure is fully embedded into the non-woven mesh layer structure, after applying said yarn layer structure to said non-woven mesh layer structure, the method further comprises the step of at least one time pressing the yarn layer structure into the molten polymer material forming the non-woven mesh layer structure.

In order that the present invention may be more readily understood, specific embodiments will now be described with reference to the accompanying drawings in which:

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposed of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
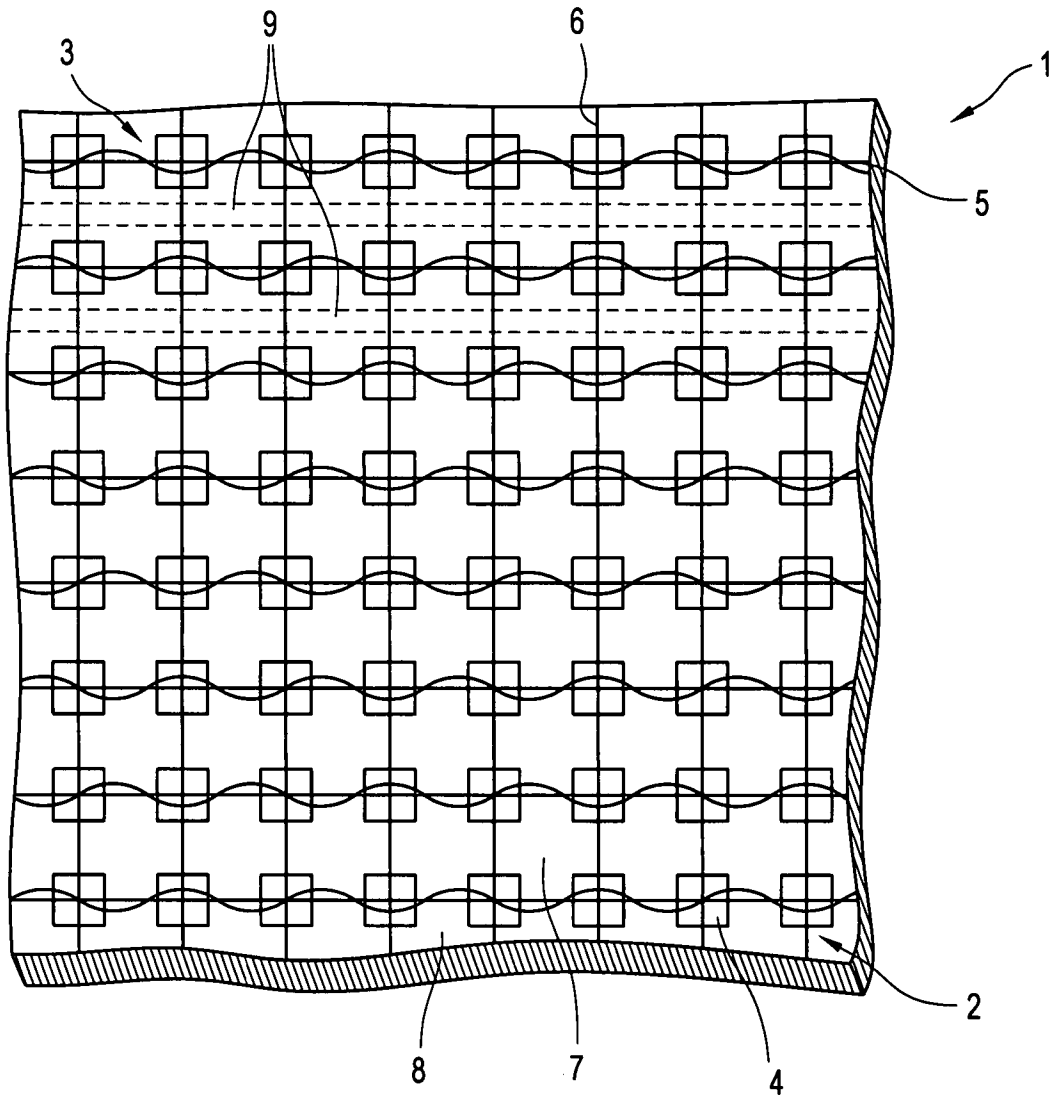
FIG. 1 is a top view onto a part of a composite layer of an industrial fabric according to the invention.

FIG. 1 is showing a top view onto a part of a composite layer 1 of an industrial fabric according to the invention. The composite layer 1 comprises a non-woven mesh layer structure 2 and a yarn layer structure 3 being parallel arranged thereto.

The non-woven mesh layer structure 2 mainly consists of a polymeric matrix material 8 and polymeric core material 9 (dashed areas). The polymeric core material 9 has a higher melting temperature than the matrix material. During production the polymeric matrix material 8 has been molten and forced to cross link adjacent polymeric core material 9 and to embed core material 9. The polymeric core material 9 forms parallel arranged reinforcing yarns 9 extending into the intended machine direction of the fabric and being cross linked by the polymer matrix material 8 and being embedded in the polymer matrix material 8.

The non-woven mesh layer structure 2 comprises a plurality of apertures 4 being equally distributed. The mesh structure of the non-woven mesh layer structure 2 is determined by the apertures 4 per surface unit of the non-woven mesh layer structure 2, their shape, their size and their distribution. The polymeric matrix material thus has a plurality of predetermined apertures 4.

According to the invention the yarn layer structure 3 is embedded in part into the non-woven mesh layer structure 2. The yarn layer structure 3 has been embedded into the non-woven mesh layer structure 2 during production at a stage where the polymeric matrix material was molten. Therefore the melting temperature of first yarns 5 and second yarns 6 is higher than the melting temperature of said matrix material 8.

The yarn layer structure 3 comprises first yarns 5 and second yarns 6. The first yarns 5 are arranged in pairs extending parallel to the intended machine direction of the fabric and are connected to the second yarns 6, which extend parallel to the intended cross machine direction of the fabric. The yarn layer structure 3 of the embodiment shown in FIG. 1 is in the form of a Leno weave.

First yarns 5 are multifilament type yarns. Second yarns 6 are monofilament type yarns. Further first yarns 5 and second yarns 6 comprise glass fibre.

First yarns 5 and second yarns 6 are connected by interweaving to form a mesh like structure having apertures 7. The mesh structure of the yarn layer structure 3 is determined by the number of apertures 7 per surface unit of the non-woven mesh layer structure 2, their shape, their size and their distribution.

As can be seen in FIG. 1, the mesh structure of the non-woven mesh layer structure 2 is different to the mesh structure of the yarn layer structure 3. In the embodiment the mesh structure of the yarn layer structure 3 exhibits an greater open area (number of apertures 7 multiplied with the size of the apertures 7) per surface unit than the mesh structure of the non-woven mesh layer structure 2. The permeability of the composite layer 1 further can be influenced by the relative arrangement of the non-woven mesh layer structure 2 to the yarn layer structure 3. As can be seen in FIG. 1 the non-woven mesh layer structure 2 is arranged to the yarn layer structure 3 in such a manner that at least mainly all first 5 and second yarns 6 extend into the aperture 4 of the non-woven mesh layer structure 2, thereby reducing the permeability of the composite layer 1.

The industrial fabric according to the invention preferably is a paper machine clothing, e.g. a forming fabric or a dryer fabric or a press felt.

Figure 2:
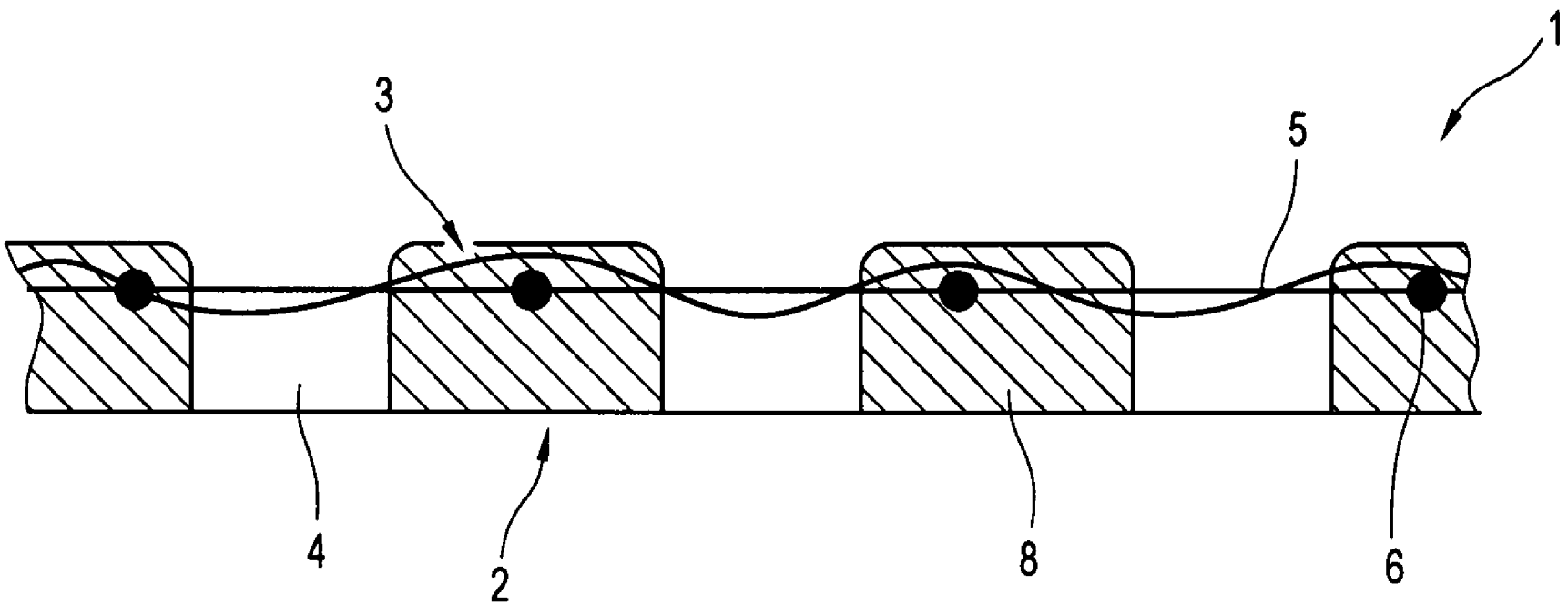
FIG. 2 is a side view of the composite layer of FIG. 1.

FIG. 2 shows a cut along the intended machine direction of the composite layer 1 shown in FIG. 1.

As can be seen, the cut goes through the apertures 4 of the non-woven mesh layer structure 2.

In FIG. 2 first yarns 5 extend in the plane of the drawing. Further second yarns 6 extend perpendicular to the plane of the drawing.

Yarn layer structure 3 is embedded partially into the non-woven mesh layer structure 2. Where first yarns 5 and second yarns 6 overlap the non-woven mesh layer structure 3 said yarns 5 and 6 are embedded into the polymeric matrix material 8 of said structure 3. Further where first yarns 5 and second yarns 6 do not overlap the non-woven mesh layer structure 2 said yarns 5 and 6 are not embedded into polymeric matrix material 8, as it is the case where the non-woven mesh layer structure 2 forms apertures 4. Therefore first yarns 5 and second yarns 6 extend in the aperture 4 of the non-woven mesh layer structure 2 influencing the permeability of the composite layer 1.

Not shown in the embodiment of FIGS. 1 and 2 is the possibility that the yarn layer structure 3 is fully embedded into the non-woven mesh layer structure 2. This would e.g. be the case if the yarn layer structure 3 would be arranged in such a manner relative to the non-woven mesh layer structure 2 that non of the first yarns 5 and/or second yarns 6 would extend in the apertures 4 of the non-woven mesh layer structure 2.

Figure 3:
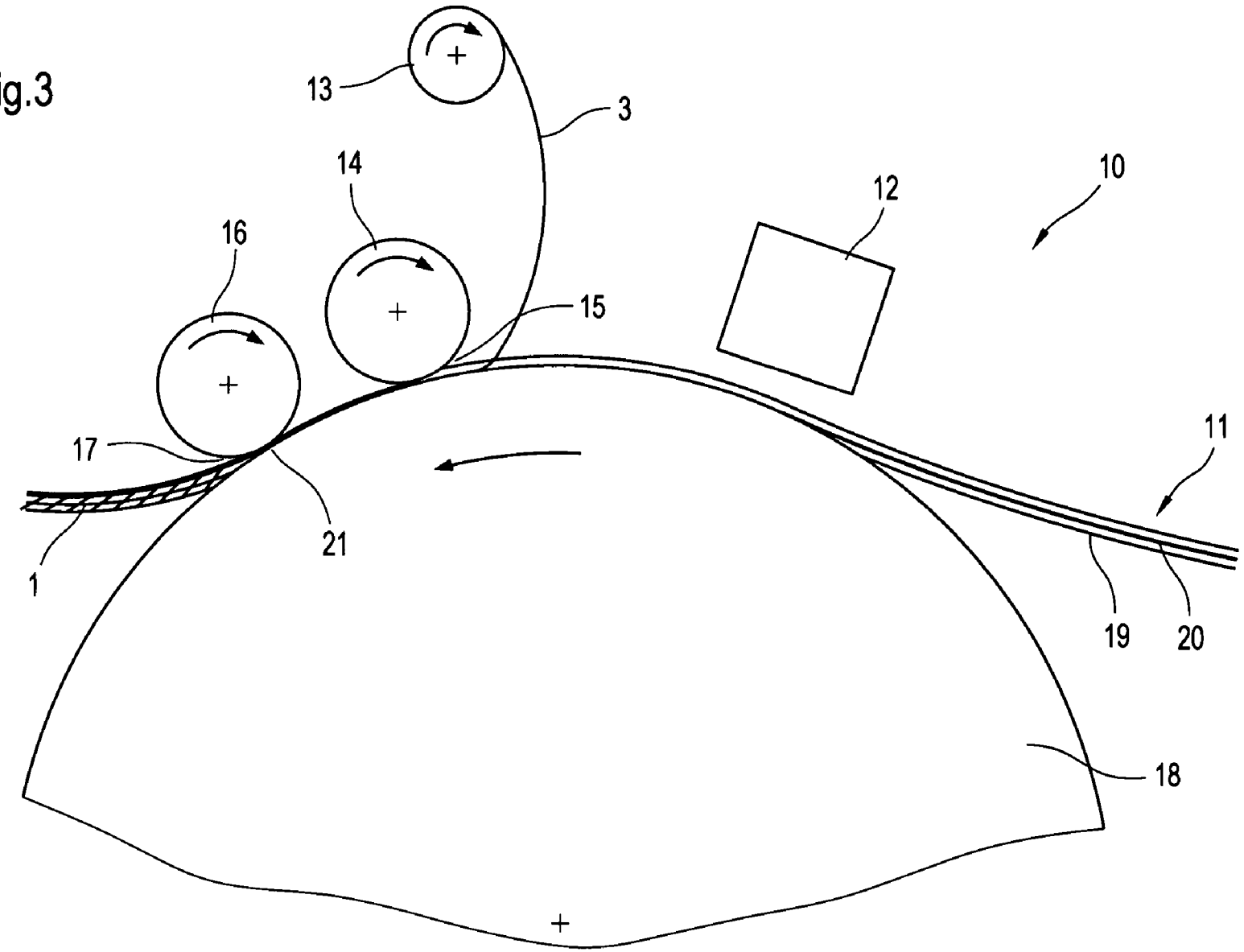
FIG. 3 is a side view of an apparatus to perform the method according to the invention.

FIG. 3 shows a side view of an apparatus 10 to perform the method of manufacturing an industrial fabric according to the invention.

An array of spaced apart yarns 11, each of said yarns having a polymeric sheath 19 embedding a polymeric core 20 is fed onto a rotating pinned drum 18. The sheath 19 having a melting temperature which is lower than the melting temperature of the core 20. The yarns 11 are heated by a heating supply 12 to melt the polymeric sheath 19 without melting the core 20.

The heating supply 12 in the specific embodiment is an induction heater. An induction heater is not itself a source of heat—but generates an electromagnetic field within the metal. This heats up the surface of the metal. The heating of the metal is effectively induced thought translation of electromagnetic energy in to thermal energy. For sure there are many ways of heating mechanisms suitable, such as InfraRed, Microwave (of course in these cases the heating the polymer material would be directly). further it is possible to heat the pin drum internally, e.g. electrically or by use of oil coils etc.

During formation of the non-woven mesh layer structure 2 the yarn layer structure 3 is applied by a feeding roll 13 to the molten polymeric sheath material 19 later forming the polymeric matrix material 8 of the non-woven mesh layer structure 2.

The molten sheath material 19 together with core 20 and the yarn layer structure 3 is subjected to pressure provided by a press-nip 15 formed by the pinned drum 18 and a press roll 14.

The pressure is applied perpendicular to the intended flow movement direction of the molten polymeric sheath material 19 and forces the molten polymeric sheath material 19 to flow along predetermined paths, provided by the pinned drum 18, to extend between and to cross link adjacent core yarns 20. Further the pressure forces the polymeric sheath material 19 to flow along individual paths in the longitudinal direction of the core yarns 20. The paths are provided by the pinned drum 18 and arranged in spaced apart disposition.

In addition the pressure forces the yarn layer structure 3 to be embedded into the molten polymeric sheath material 19 forming the polymeric matrix material 8 of the non-woven mesh layer structure 2.

By doing that the composite layer 1 is formed.

The molten sheath material 19 together with core 20 and the embedded yarn layer structure 3 is subjected to further pressure provided by a second press-nip 21 formed by the pinned drum 18 and a press roll 16.

After the second press nip the finished composite layer 1 is removed from the pinned drum 18.

While the invention has been described in detail, it will be apparent to one skilled in the art that various changes and modifications can be made therein without departing from the spirit and scope thereof.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

The invention claimed is:

1. An industrial fabric having a composite layer, the composite layer comprising:

a yarn layer structure including a plurality of first yarns and a plurality of second yarns which are interwoven together to form a leno weave;

a continuous polymeric matrix material having a plurality of predetermined apertures and parallel to the yarn layer structure; and a plurality of reinforcing yarns arranged in parallel extending in the intended machine direction of the fabric and which are not woven with any other yarns, wherein the polymeric matrix material at least partially embeds the yarn layer structure and the polymeric matrix material embeds the plurality of reinforcing yarns, and wherein the industrial fabric being a paper machine clothing.

2. The industrial fabric of claim 1 wherein at least some of the yarns in at least one of the first and second yarns are at least one of monofilament, twisted monofilament, multifilament and spun type yarns.

3. The industrial fabric of claim 1, wherein at least some of said first and second yarns are selected from the group consisting of a glass fiber and an aromatic aramid fiber.

4. The industrial fabric of claim 1, wherein at least some of said first yarns or second yarns are flat yarns.

5. The industrial fabric of claim 1, wherein the first yarns extend into the intended machine direction of the clothing.

6. The industrial fabric of claim 1, wherein the permeability of the composite layer can be influenced by the relative arrangement of the polymeric matrix material to the yarn layer structure.

7. The industrial fabric of claim 1, wherein the polymeric matrix material and the yarn layer structure are arranged in such a manner that at least some of the at least one of the first and the second yarns extend through a plurality of the predetermined apertures of the polymeric matrix material.

8. The industrial fabric of claim 1, wherein a melting temperature of at least one of the reinforcing yarns, the first yarns and the second yarns is higher than the melting temperature of the matrix material.

9. The industrial fabric of claim 1, wherein the second yarns extend into an intended cross machine direction of the clothing.

10. The industrial fabric of claim 1, wherein the paper machine clothing is at least one of a forming fabric, a dryer fabric, a press felt and a transfer belt.

11. The industrial fabric of claim 1, wherein the papermachine clothing is permeable.

12. The industrial fabric of claim 11, wherein said polymeric matrix material includes a top surface and a bottom surface and defines a plurality of through-holes running from said top surface to said bottom surface, said first and second yarns of said yarn structure extending transversely through at least certain ones of said plurality of through-holes.

* * * * *

UNITED STATES PATENT AND TRADEMARK OFFICE

CERTIFICATE OF CORRECTION

PATENT NO. : 7,749,925 B2
APPLICATION NO. : 11/227773
DATED : July 6, 2010
INVENTOR(S) : Antony Morton It is certified that error appears in the above-identified patent and that said Letters Patent is hereby corrected as shown below:

In the specifications:

COLUMN 3

At line 54, between "materials" and "Glass", insert sentence --E.g. glass fibre is extremely cheap and possesses a low coefficient of thermal expansion, compared to thermoplastic materials.--.

Signed and Sealed this

Thirtieth Day of November, 2010

David J. Kappos

David J. Kappos
*Director of the United States Patent and Trademark Office*